US006286666B1

(12) United States Patent
Umdasch

(10) Patent No.: US 6,286,666 B1
(45) Date of Patent: Sep. 11, 2001

(54) CONTAINER FOR THE STORAGE OF CONTACT LENSES

(75) Inventor: Stefan Umdasch, Vienna (AT)

(73) Assignee: Stefen Umdasch Design KG, Vienna (AT)

( * ) Notice: Subject to any disclaimer, the term of this patent is extended or adjusted under 35 U.S.C. 154(b) by 0 days.

(21) Appl. No.: 09/490,572

(22) Filed: Jan. 25, 2000

Related U.S. Application Data

(63) Continuation of application No. PCT/EP98/04623, filed on Jul. 23, 1998.

(30) Foreign Application Priority Data

Jul. 30, 1997 (AT) ..... 478/97 U
Oct. 3, 1997 (AT) ..... 615/97 U

(51) Int. Cl.[7] ..... A45C 11/04
(52) U.S. Cl. ..... 206/5.1; 206/205
(58) Field of Search ..... 206/5.1, 5, 205, 206/210; 134/901; 422/301; D3/264

(56) References Cited

U.S. PATENT DOCUMENTS 3,253,702 5/1966 Ray .
4,691,725 * 9/1987 Parisi ..... 206/5.1
4,942,959 7/1990 Sauber et al. .
5,131,532 * 7/1992 Ives ..... 206/5.1
5,167,323 * 12/1992 Ohta et al. ..... 206/5.1
5,383,550 * 1/1995 Tsao ..... 206/5.1
5,431,879 * 7/1995 Heyl et al. ..... 206/5.1
5,439,572 * 8/1995 Pankow ..... 206/5.1
5,657,506 * 8/1997 Pankow ..... 206/5.1

FOREIGN PATENT DOCUMENTS 1 276 301 8/1968 (DE) .
1130853 10/1968 (GB) .

OTHER PUBLICATIONS

International Search Report for PCT/EP98/04623, dated Jan. 1, 1999 (2 pgs.).

* cited by examiner

*Primary Examiner*—Luan K. Bui
(74) *Attorney, Agent, or Firm*—Fitch, Even, Tabin & Flannery

(57) ABSTRACT

The invention relates to a container for storing contact lenses. The inventive container can be filled with a liquid for wetting the contact lenses, and consists of a bottom container part and a top container part. Said top container part can be closed on the bottom container part in such a way that the container is water-tight. A receiving part for receiving the contact lenses is located in the bottom container part. A lid part which is provided in the top container part interacts with the receiving part in the bottom container part when the container is closed.

19 Claims, 5 Drawing Sheets

CONTAINER FOR THE STORAGE OF CONTACT LENSES

This is a continuation, of prior application number PCT/EP98/04623, filed Jul. 23, 1998, designating the United States, which is hereby incorporated herein by reference in its entirety.

TECHNICAL FIELD

The invention concerns a container for storing contact lenses which can be filled with a liquid for wetting the contact lenses.

PRIOR ART

Containers for storing contact lenses are known in various designs. Usually such containers are filled with a disinfecting liquid and for their storage, in particular for overnight storage, the contact lenses are put into the liquid and the container is closed. The removal of contact lenses from such containers filled with liquid is not always easy, since on the one hand the contact lenses when immersed in liquid are difficult to see with the naked eye and on the other, to grasp the contact lenses in the liquid is not always easy. It is therefore suggested in U.S. Pat. No. 5,167,323 that the contact lenses should be placed in a kind of basket-like container and to connect this basket-like container thereafter with a vessel open at the top. This connection, for example, takes place by screwing on a cover which has on its underside the container. But with such a procedure there is still the danger that the contact lenses will not be completely immersed in the liquid if the container is not filled exactly to its minimal level with disinfecting liquid. When opening the container to remove the contact lenses, there is furthermore the danger that the liquid will drip outside the container, and then this causes the necessity for cleaning.

In addition, a container for storing contact lenses is known from U.S. Pat. No. 4,942,959, which comprises two compartments disposed adjacent to each other and separate from each other. Each compartment is provided for the accommodation of one contact lens and can be closed by one cap each. Each compartment has a removal device with convex surface to place a contact lens on it. The removal device can be removed from the container filled with liquid by opening and closing the covers or it can be lowered into the container. Thus it is possible to remove a contact lens from the compartment concerned without the fingers coming into contact with the liquid. However with this known container a complete rinsing of the contact lenses is not guaranteed, if there is not a sufficient liquid level in the individual compartments. Moreover the removal device which can be lowered and raised requires a comparatively complicated structure of the container and therefore high production costs.

DESCRIPTION OF THE INVENTION

The object of the present invention now consists of providing a container of the type mentioned above, which guarantees in a simple manner that after the closing of the container the contact lenses do in fact arrive below the liquid level and that they are completely rinsed by liquid. In addition, the invention is based on the object of simplifying substantially the handling and of providing the possibility to place contact lenses in the container and to remove them from the container in a way such that the fingers do not come into contact with the liquid.

The solution of these problems is carried out by the container described herein for the storage of contact lenses.

Consequently the container in accordance with the invention can be filled with a liquid which wets the contact lenses and comprises a bottom part and an upper part of the container. The top container part can be closed in sealing manner with the bottom container part, for example by means of a hinge or a knuckle or link connection with a closing device. The container is preferably made of any type of discretionary plastic material, to achieve an especially light construction. The bottom container part defines a hollow space for the accommodation of the liquid and has an accommodation part for the contact lenses. The contact lens accommodating part in one position of the container, in which the contact lenses can be removed from the container or can be put into it, projects above a maximal liquid level in the bottom container part. By analogy the accommodating part for the contact lenses, after the opening of the container, i.e. with opened or unhinged top container part, or shortly before the opening, i.e. with the top container part resting on the bottom container part, is above the liquid level in the bottom container part, so that the contact lenses can be removed in the opened state of the container without direct contact with the liquid. Accordingly the contact lenses by analogy may be inserted without coming into contact with the liquid. In addition, it is possible to insert the storage liquid separately in the bottom part of the container, with the contact lenses not being wetted by the liquid.

In addition, the accommodating part interacts in the closed state of the container with a cover part arranged in the top part of the container. The accommodating part and the cover part each have openings to accommodate the contact lenses, with the edges of the openings for accommodation of the accommodating part and the cover part abutting each other preferably on their periphery and the cover part being contiguous and interacting in this manner. The accommodating part and the cover part are advantageously designed each in the form of a basket. Thus it is possible to form a closed hollow space for the accommodation of the contact lenses which is preferably adapted to the dimensions and contours of the contact lenses. Therefore safe storage of the contact lenses between the accommodating and cover parts is guaranteed.

After closing the container, a compact state of the container results. In this compact state, by pivoting the container through 180°, a stable pivoting position is at once ensured, so that the contact lenses are rinsed by the cleaning or disinfecting liquid. Thereby during pivoting into the stable pivot position, the lower part of the container arrives above the upper part of the container, so that the liquid which had originally been placed in the container lower part flows into the upper part of the container. Thereby it is ensured that the accommodating part and the cover part come to rest with the contact lenses below the level of the liquid in the zone of the upper part of the container. Due to the pivot movement, which takes place relatively suddenly like a "roly-poly", it is ensured simultaneously that no air bubbles remain enclosed between the contact lenses and the liquid which wets them, because these bubbles are washed away during the pivot movement. Because in accordance with the invention the complete immersion of the contact lenses only takes place in the stable pivot position, small amounts of the wetting liquid, which are inadequate to wet the contact lenses, can be used. In this context, by corresponding design of the cavities in the upper part and lower part of the container, sufficiently deep immersion of the contact lenses is ensured in the liquid.

The necessary tilting moment to achieve the stable pivot position can be attained in a simple manner in that the upper part of the container consists of a specifically heavier material than its lower part and/or it contains inlays of specifically heavier material, in particular of metal.

By "the lower part of the container" what is meant is that part of the container which in the open state of the container or immediately after the closure of the container is under the upper part of the container. On the other hand, in the stable pivot position of the closed, compact container, the lower part of it is above the upper part of the container. In accordance with the invention it is sufficient correspondingly to characterize or to design a container part, in order to make it discernible in which way the container has to be opened, i.e. which container part forms the upper part and which forms the lower part.

For opening the container it in turn has to be tilted back into a metastable pivot position, i.e. initial position for opening and closing. During opening, unintended escape of the liquid is prevented without difficulty, because the liquid is caught in the lower part of the container. At the same time, in the opened state, the contact lenses are in turn easily visible and are ready to be easily grasped in the accommodating part. In addition it is ensured that surplus liquid drips from the contact lenses into the lower part of the container and has already dripped away before the removal of the contact lenses, so that loss of liquid is prevented when the contact lenses are taken out.

Preferred further developments of the invention are described in the other claims.

For shaping the container, it has been found to be advantageous when the container has an egg-shaped contour. But in addition a spherical, conical, cylindrical or polygonal form is preferred for the container. Thereby the container, after closing, can easily be rolled or moved on its periphery into a position which ensures that the contact lenses are below the level of the liquid. The shaping of the container is always carried out so that after the closing, due to the force of gravity, a pivot position is at once adopted, in which the wetting of the contact lenses can certainly be achieved.

In order to make possible automatic tilting of the container only under the influence of gravity into the stable pivot position after completely closing the upper part of the container with the lower part of the container, there are advantages when the upper part of the container has a weight which is greater than the weight of the lower part of the container full of liquid. In the case of an egg-shaped or spherical outline, the stable pivot position can be certainly achieved with only minor weight differences. In the case of polygonal, cylindrical or spherical outline, care has to be taken that the space required by a polygon, cylinder or a cone is always chosen to be sufficiently small to ensure that after closing the container, a metastable state results, out of which the pivoting takes place automatically into the stable pivot position.

For an adequate entry of liquids into the space which is formed between the cover part and the accommodating part, there are advantages when the accommodating part and/or the cover part have openings or apertures. Preferably the accommodating part and/or the cover part are designed in this connection as a small basket with pierced or sieve type walls. To ensure that different contact lenses for different eyesight errors in both eyes are used correctly, the accommodating part has preferably two separately identified compartments which are separated from each other, e.g. by a sieve wall or a continuous partition wall. These compartments are marked, for example, with a "R" (for right) for the insertion of the righthand contact lens and with an "L" (for left) for the insertion of the lefthand contact lens.

An especially simple and favourable design for the rolling process of the container can be achieved by designing the upper part of the container as the sharp end of an egg-shaped container, in which the sharp end is designed to be correspondingly heavier, so that the stable pivot position is achieved due to the fact that the egg-shaped container comes to a stop on its sharp end. The heavier design of the upper part of the container has as a rule the result that the volume accommodated in the upper part of the container is less than the volume of the cavity in the lower part of it, so that a sufficiently high liquid level is ensured, which guarantees the safe immersion of the contact lenses in their stored position.

In an especially simple manner, the design is chosen so that the upper part of the container is hinged or foldable on the lower part of the container, for example by means of a joint, a hinge or a flexible plastic strip and can be pivoted in an opened position in a joint space with the lower part of the container. In this way, after folding out the upper part of the container in the joint space, immediately a stable position of the opened container is again ensured, so that the contact lenses can drip in a simple manner, are accessible without difficulty and also the filling of the liquid becomes possible.

For an especially simple design of the container it is an advantage that the upper part and the lower part of the container close with each other in a divisional plane which is half the height of the container when tilted into its stable position. In this way, on the one hand a joint standing area is ensured in the opened state without additional modifications of the outer wall of the container and on the other hand, the sealing between the upper and lower parts of the container is simplified, because this sealing can now be formed as a sealing ring in the divisional plane from any discretionary sealing material, e.g. an O-ring or rubber.

For easy accessibility to the accommodating part and therefore to the contact lenses when the container is open as well as for a simple fastening of the cover part in the upper part of the container, there are advantages when the accommodating part is connected with the lower part of the container and/or the cover part is connected with the upper part of it by at least one connecting element, e.g. a column or a strut. Thereby it becomes possible that on the one hand the accommodating part, when the upper part is opened, is above the dividing plane and projects into it when the upper part of the container is closed. On the other hand, the spacing between the cover part and the inner wall of the upper part of the container can be adapted by the choice of a corresponding length for the connecting element, so that the cover part comes to rest when the container is closed on the accommodating part and closes the latter. Here the accommodating part is for example glued or screwed to the connecting element and/or the cover part is e.g. glued or screwed to the upper part of the container, or they are also connected by a snap closure.

In order to achieve in the stable pivot position an adequate level of liquid in the original upper part of the container, which is pivoted downwards in the stable pivot position, there is a cavity of the upper part in the container which supports the cover part and is smaller than the cavity of the container lower part which can be filled with liquid. A corresponding design of the cavity in the upper part of the container ensures, even with small amounts of liquid, secure immersion of the accommodating part and therefore of the contact lenses into the liquid level in the stable pivot position for the storage of the contact lenses.

To facilitate the replacement of the cleaning and storage liquid, without having to remove the contact lenses from the accommodating part and in order to avoid when pivoting the open container to pour off the liquids, that the contact lenses may be lost, it has found to be an advantage to connect the accommodating part detachably with the lower part of the container and that it supports a stand part or can be connected detachably with a stand part. In this connection, the accommodating part can be detached from the lower part of the container, for example from a plug-in connection and can be set up separately. Thereby the contact lenses can remain in the accommodating part. In this way the cleaning liquid can easily be replaced and the container can be pivoted at discretion to pour off the cleaning liquid, without the contact lenses being lost.

For secure closure of the container with contact lenses and with liquid, there are advantages when the upper part of the container and the lower part of it can be closed or latched in with a closing part in the closed state. To do this the upper part of the container can, for example, be applied, latched in or locked on the lower part of the container by means of a pivot joint and a locking member or by a snap closure. When using a pivot joint, a snap closure or a locking member, it is only necessary to take care that the stable pivot position can be achieved without adverse effects. When the pivot bearing, the snap closure and/or the locking member are correspondingly rounded off and dimensioned, the container, during its pivoting under the influence of gravity, can always escape in a direction in which the stable pivot position can be achieved.

In this connection it is advantageous when for the transport on the closing part or on the container a clasp, a clamp or a clip is applied. This clasp, clamp or clip fixes and surrounds at least partially the two parts of the container. In this way the securely closed container can be clipped or stuck on, as with an ejector pin, in particular a ball point or a fountain pen, on to pockets of articles of closing and it can be transported securely in the correct position in which by suitable alignment of the clasp, the clamp or the clip, the correct position can be ensured during transport, in which the contact lenses are completely rinsed by liquid.

In order to ensure that the container is pivoted after being closed into the position in which the contact lenses are totally rinsed by liquid, it is preferable that the upper part of the container has a standing area and that the lower part of the container on its opposite side to the standing area of the upper part of the container in the closed state has a zone which is formed by a point or a straight line. Thus the container can either be manually placed on the upper part of the container or it can be pivoted automatically to a tilt position. Because only one of the two parts of the container forms the standing area, it is possible for the container after being closed and under the influence of gravity and while maintaining compactness, to arrive by automatic tilting into a position in which the contact lenses are surely rinsed by liquid, because of the volume of the liquid which is available respectively in both container parts the contact lenses are safely rinsed by liquid in the amount of liquid of the container which is on the standing area. Such a standing area can also ensure the secure and stable position in the open state, in which the container in the opened position rests on the standing area of the upper part of the container and the lower part of the container is located above a point or line contact.

In order to improve the handling of the container, it has been found to be an advantage that an outer surface of the container, i.e. the surface which can be recognized from the exterior by the user, has different colours, patterns and/or structures. Thereby, for example, the container part which is to be directed upwards when being opened can be correspondingly identified. For this purpose the container can also have a uniform colour, pattern and/or structure on its surface. By these possibilities of design which are various and almost infinite for the surface of the container, there is the great advantage that when using a plurality of containers, they can easily be differentiated from each other. Thus the hygienic conditions can also be improved, because a container which has already been used can easily be differentiated from a new, disinfected container. In addition, the incentive to purchase is always present for a new container with a different texture and appearance.

BRIEF DESCRIPTION OF THE DRAWINGS

Some exemplary embodiments which are shown in the drawings of the invention will be explained in more detail below. They show.

DESCRIPTION OF EXAMPLES OF EMBODIMENTS OF THE INVENTION

Figure 1:
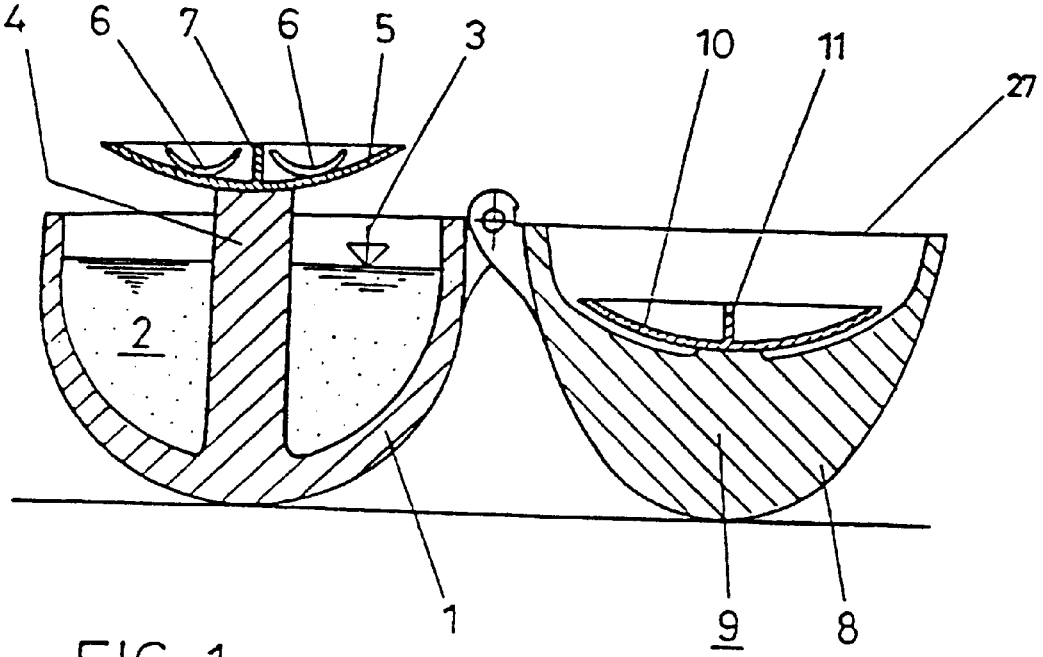
FIG. 1 a cross-section view of a first embodiment of a container in accordance with the invention in the open state.

In FIG. 1, a bottom part of container 1 is shown which is filled with liquid 2 up to a liquid level 3. The lower part of the container has a central support column 4 made of plastic, which is integrally connected with the lower part 1 of the container and on which an accommodating part 5 for the contact lenses 6 is fixed. The support column 4 projects with the accommodating part 5 above the liquid level 3. The accommodating part 5 as well as a partition wall 7 which is located between two individual compartments of the accommodating part 5 are formed in this connection with openings, so that bracings are formed and the contact lenses are thus stored separately from each other. An upper part and/or an upper cover part 8 of the container is also made of plastic and because of a heavy head zone 9 it is in principle heavier than the lower part 1 of the container, in which in addition specifically heavier material or layers of specifically heavier material can be introduced. The upper part 8 of the container contains a cover part 10, in which in its turn a partition wall element 11 is provided, which in the closed state of the container (FIGS. 3 to 6) is flush with the partition wall element 7 of the accommodating part 5. The cover part 10, the partition wall elements 7 and 11 as well as the accommodating part 5 are perforated and/or of the sieve type, in order to ensure the certain rinsing of the contact lenses. The cover part 10 is positioned at a point in the inner wall of the upper part 8 of the container, and in the present case it is connected with the inner wall of the upper part of the container at the deepest point of the cavity which is defined by the inner wall.

Figure 2:
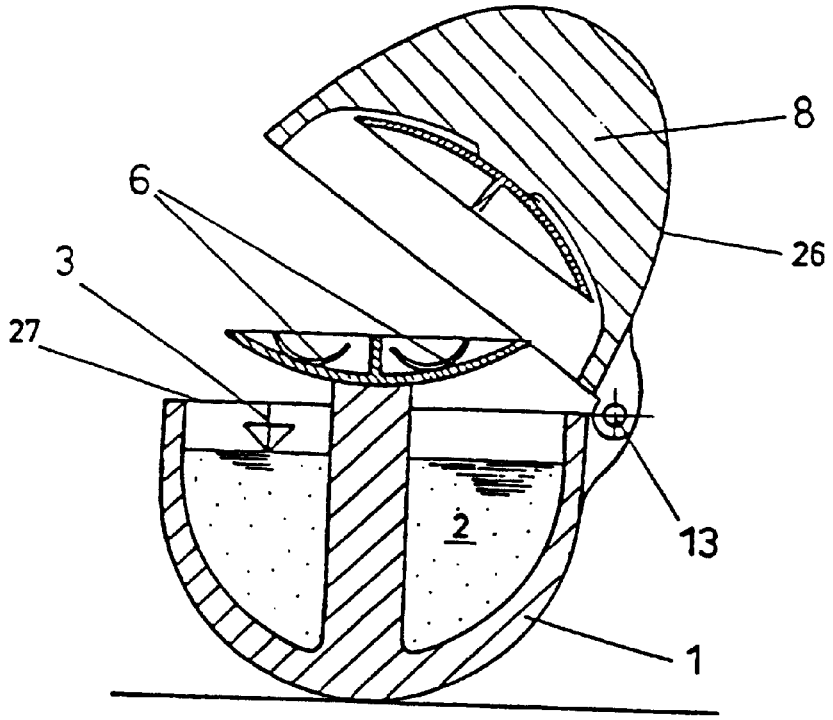
FIG. 2 a cross-section view of a partly closed container in accordance with the first embodiment.

In FIG. 2, it can be seen that the upper part 8 of the container can be pivoted around a tilt axis 13 to close it in a closed state of the container, in which the contact lenses 6 are still arranged above the level 3 of the liquid in the lower part 1 of the container. The support column 4 for the accommodating part 5 projects above the liquid level 3 in the container. Between the upper part 8 and the lower part 1 of the container, there is in a divisional plane 27 of the container a corresponding sealing element which is not shown in more detail. In addition, an external or upper surface 26 of the container has a pattern in different colours, in order to design the appearance of the container attractively for the user. At the same time, the container part which is to be held upwards when opening and closing is indicated by an inscription which is not present in the drawing.

Figure 3:
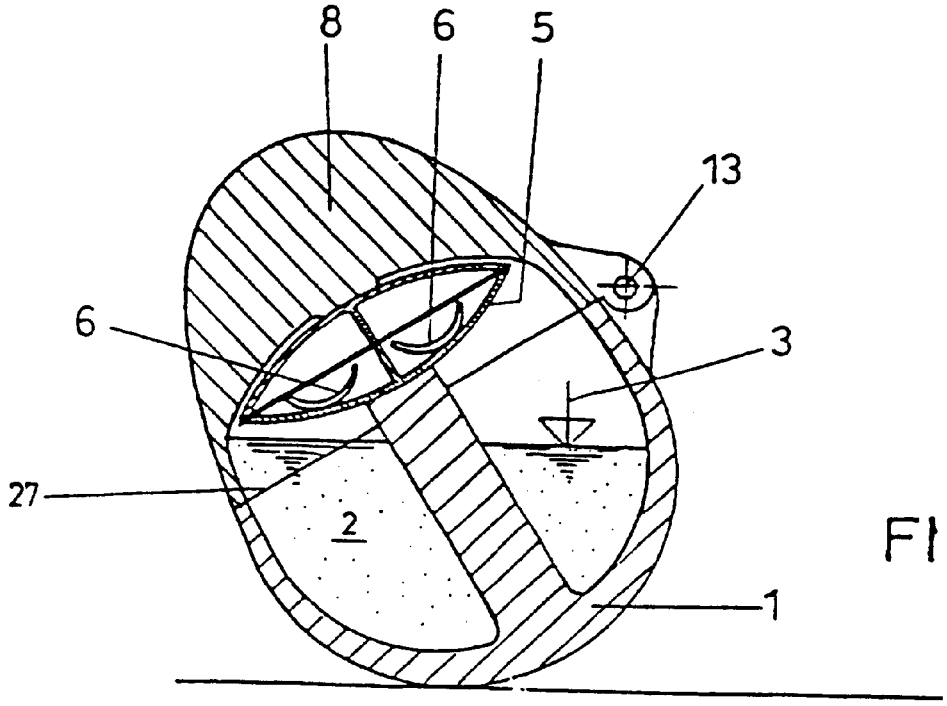
FIG. 3 a cross-section view of a closed, partly pivoted container in accordance with the first embodiment.
Figure 4:
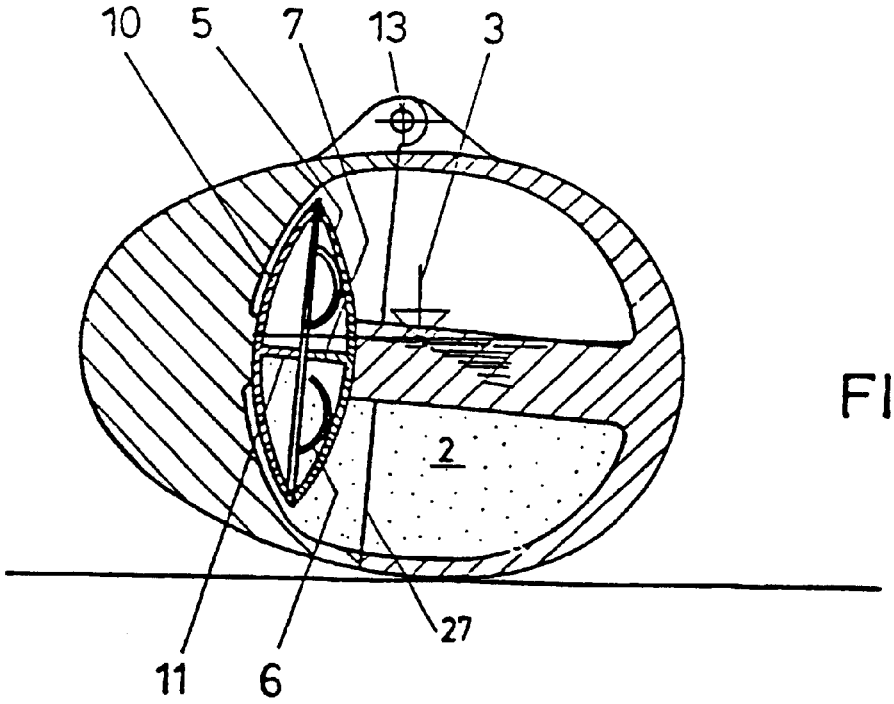
FIGS. 4 and 5 different pivot positions which the closed container in accordance with the first embodiment takes up under the influence of gravity.
Figure 5:
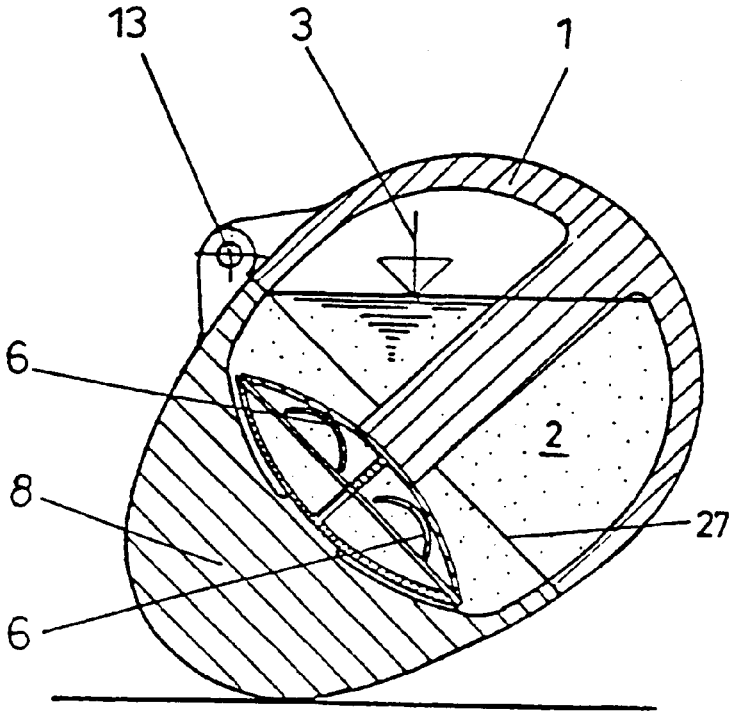
Figure 6:
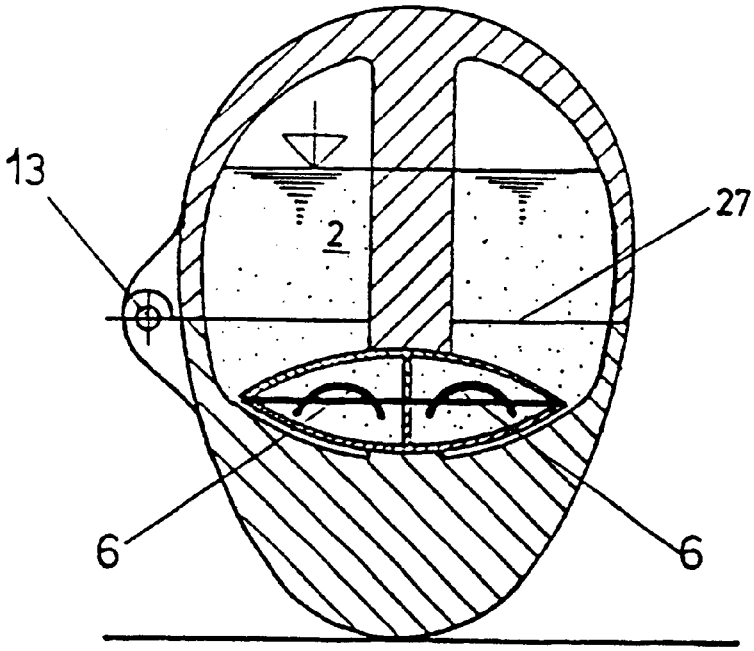
FIG. 6 a cross-section view of the container in accordance with the first embodiment in its stable pivot position.

After the complete closing of the mainly egg-shaped container under the influence of gravity, the pivoting of the closed container begins as shown in FIG. 3. In this connection the pivoting of the closed, compact container is carried out via the pivot positions which are shown in FIGS. 3, 4 and 5 under the influence of gravity into a stable pivot position which is shown in FIG. 6. In the process of the pivot movement which is shown in FIG. 3, the accommodating part 5 is now immersed with the contact lenses 6 in the liquid 2, in which in a first phase, as shown in FIG. 4, a contact lens 6 comes to rest under the liquid level 3. Because of the perforated walls of the accommodating part 5 and/or of cover part 10 and of the partition wall elements 7 and 11, the contact lenses 6 are safely rinsed, whereby at the same time due to the pivot movement, the washing off of air bubbles which are formed in certain circumstances is carried out.

Shortly before reaching a stable pivot position, as is shown in FIG. 5, both contact lenses 6 are already below the liquid level 3. Due to the dimensions of the cavities in the upper and lower parts of the container, in this case even with smaller amounts of liquid, safe immersion is ensured.

A stable pivot and/or storage position is now shown in FIG. 6, from which it can be seen that even with low liquid volumes, the contact lenses are safely kept below the liquid level 3 in the storage position. To open it, the container has to be pivoted from the stable position which is shown in FIG. 6 through 180° again. Then, when opening the upper part 8 of the container while opening additional closure members which are not shown in more detail, immediately a stable position can again be adopted, as can be seen in FIG. 1.

In this stable position in accordance with FIG. 1, surplus liquid can drop from the contact lenses 6 and from the accommodating part 5 into the cavity in the lower part 1 of the container. The contact lenses 6 in the open position of the container which is shown in FIG. 1 are easily and simply accessible, because the support column 4 and therefore the accommodating part 5 projects above the liquid level and can easily be removed. The accommodating parts are designed to be very flat, in order improve the accessibility of the contact lenses.

Figure 7:
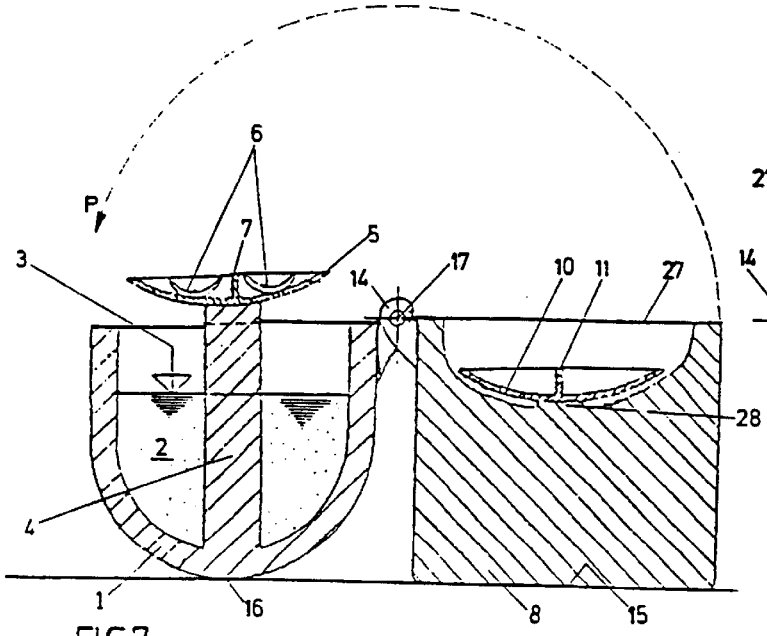
FIG. 7 a cross-section view of a second embodiment of the container in accordance with the invention in the open state.
Figure 8:
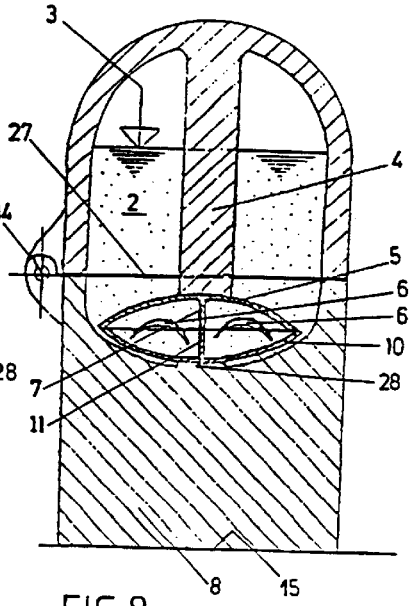
FIG. 8 a cross-section view of the container in the closed state in accordance with the second embodiment.

FIGS. 7 and 8 show a second embodiment of the container in accordance with the invention in the open state (FIG. 7) and in the closed state (FIG. 8) respectively. Here in FIG. 7 the container is filled by analogy with the embodiment which is shown in FIG. 1 with liquid 2 up to a liquid level 3. The lower part 1 of the container has a central support column 4, which is connected at one of its ends integrally with the lower part 1 of the container and at its other end integrally with the accommodating part 5 for the contact lenses 6, in which the accommodating part 5 projects above the liquid level 3. The accommodating part 5 as well as the partition wall 7 in the accommodating part are formed by bracings which are no longer shown in order to make possible the passage of the liquids through the passages which are formed between the bracings.

The upper part 8 of the container is connected with the lower part 1 of it via a joint 14, in which the upper part 8 of the container is provided with a substantially planar standing area 15. In the upper part 8 of the container the cover part 10 is positioned via a connecting element, in the present case a short column 28, on the inner wall of the cavity which is formed by the upper part of the container. In the opened position of the container which is shown in FIG. 7, it is located on the standing area 15 of the upper part 8 of the container, in which the lower part 1 of the container is also positioned above a point contact 16. The upper part 8 of the container can be closed by pivoting around the axis 17 of the joint 14 in the direction of the arrow P in sealing manner with the lower part 1 of the container.

FIG. 8 shows the container in accordance with FIG. 7 in the closed state, and after the pivoting of the container into the stable storage position, in which the container rests on the standing area 15 of the upper part 8 of the container. The accommodating part 5 forms together with the cover part 10 two interacting shells which are adjacent at their peripheral edges, and which are separated from each other by the partition walls 7, 11. Between the shells the contact lenses 6 are stored, in which due to the openings in the accommodating part 5 and/or in the cover part 10 it is ensured that the contact lenses 6 are surrounded by liquid 2. It can be seen that in this storage position, even with minor volumes of liquid, the contact lenses 6 surely arrive below the liquid level 3. To open it, the container has again to be pivoted from the position which is shown in FIG. 8 through 180°, whereby the upper part 8 of the container again moves upwards and the lower part 1 of the container again comes to rest below. Here by analogy with the drawing in FIG. 7, when the container upper part 8 is opened, the stable position is again adopted. To seal the container in the closed position, an O-ring which is not shown can be inserted in the opposite front surfaces of the upper part 8 of the container and/or of the lower part 1 of the container, in which any discretionary sealing elements can also be used.

Figure 9:
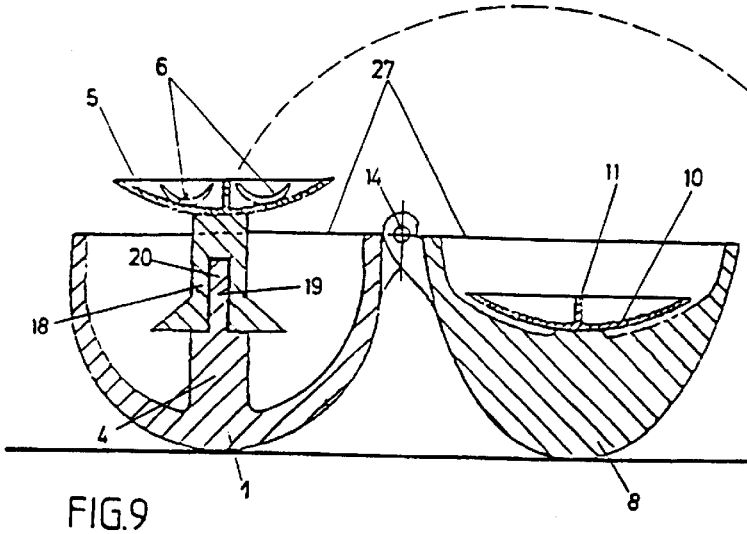
FIG. 9 a cross-section view of a third embodiment of the container in accordance with the invention with removable accommodating part.

FIG. 9 shows a modified third embodiment of a container for the storage of contact lenses, comprising a removable accommodating part 5, in which the same reference numerals are maintained for the same components. The accommodating part 5 is designed to be removable from the central support column 4, and in the present case by a plug-in connection, and it is provided with a stand part 18, in which stand part 18 has a recess 19 and is placed on a pin 20 which is arranged on the central support column 4. In this context, the plug-in connection can also be alternatively designed so that the support column 4 has a recess, for example a cylindrical recess, into which the stand part 18 which is formed to be complementary corresponding to the recess is inserted.

Figure 10:
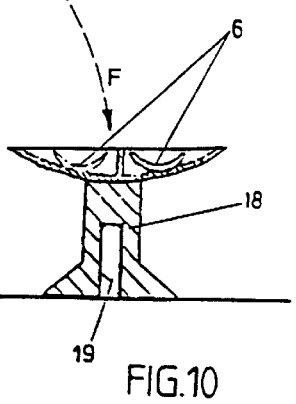
FIG. 10 a cross-section view of the accommodating part after removal in accordance with FIG. 9 in its position located on its standing zone or its base part.

As shown in FIG. 10 by arrow F, the accommodating part 5 can be removed from the lower part 1 of the container and can be positioned separately, in which the contact lenses 6 remain in the accommodating part 5, while e.g. the cleaning liquid is replaced. The cover part 10, the accommodating part 5 and the partition wall 7, 11 are designed to be perforated or in sieve form.

Figure 11:
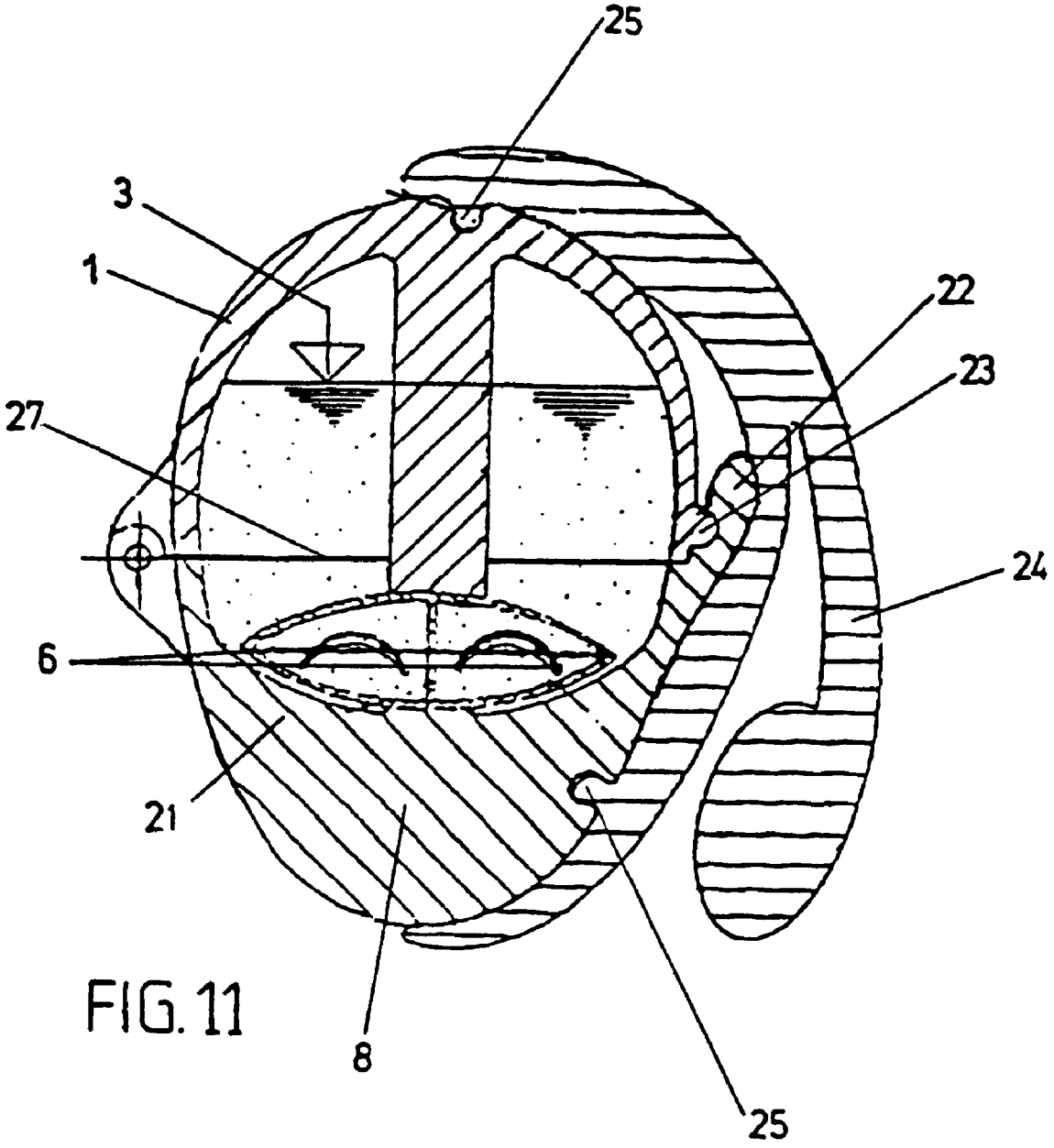
FIG. 11 a cross-section view of a fourth embodiment of the container in accordance with the invention.

FIG. 11 shows a further embodiment of a container in accordance with the invention in cross-section, in which for the same components the same reference numerals are used. A container 21 which carries cover part 10 is designed to be mainly round and it has a closing part 22. The closing part 22 takes effect by interacting with a projection 23 of the lower part 1 of the container similar to a snap closure, so that the two container parts 1 and 8 can be latched in the closed state. In addition, on container 21 there is a clamp 24 in latch recesses 25, with which container 21 can e.g. be clamped or clipped on articles of clothing (similar to a ball point pen) in the correct position.

What is claimed:

1. A container for the storage of contact lenses, which can be filled with a liquid which wets the contact lenses, comprising a lower part of the container, which has a cavity which can be filled with the liquid and an accommodating part for the contact lenses, an upper part of the container, which can be closed in sealing manner with the lower part of the container in a closed position, and also has a cavity, and a cover part in the upper part of the container, which cover part interacts with the accommodating part in the lower part of the container when the container is in the closed position, wherein the upper part of the container has a weight which is greater than the weight of the lower part of the container filled with the liquid, the weight of the upper part of the container creating a stable position when the upper part of the container is disposed beneath the lower part of the container, and wherein the lower part of the container has an arcuate contour and the weight of the upper part of the container tends to tilt the container to the stable position with the lower part of the container above the upper part of the container.

2. A container in accordance with claim 1 with an oval outline.

3. A container in accordance with claim 1, wherein the accommodating part and/or the cover part have openings or passages for the entry of the liquid.

4. A container in accordance with claim 1, wherein the accommodating part has two separately marked and/or separated compartments.

5. A container in accordance with claim 1, wherein an outline of the upper part of the container comprises the pointed end of an oval.

6. A container in accordance with claim 1, wherein the upper part of the container is attached in hinged manner on the lower part of the container and in the closed position can be pivoted into a joint standing area with the lower part of the container.

7. A container in accordance with claim 1, wherein the upper part of the container and the lower part of the container adjoin each other in a dividing plane, which is at half the height of the container tilted into the stable position of the container.

8. A container in accordance with claim 1, wherein the accommodating part is connected with the lower part of the container and/or the cover part is connected with the upper part of the container by at least one connecting element.

9. A container in accordance with claim 1, with the cavity in the upper part of the container which supports the cover part which is smaller than the cavity of the lower part of the container which can be filled with liquid.

10. A container in accordance with claim 1, wherein the container has a stand part, the accommodating part is connected to be detachable with the associated lower part of the container and the accommodating part is supported by the stand part or the stand part can be connected with the accommodating part.

11. A container in accordance with claim 1, wherein the lower part and the upper part of the container can be closed by a closing part in the closed state.

12. A container in accordance with claim 1, wherein the upper part of the container has a stand area and the lower part of the container has on a side which is opposite the stand area of the upper part of the container in the closed position a surface zone which is formed by a point or a straight line.

13. A container in accordance with claim 1, wherein an external surface of the container has different colours, patterns and/or structures.

14. A container in accordance with claim 1 with a spherical outline.

15. A container in accordance with claim 1 with a conical outline.

16. A container in accordance with claim 1 with a cylindrical outline.

17. A container in accordance with claim 1 with a polygonal outline.

18. A container for the storage of contact lenses, which can be filled with a liquid which wets the contact lenses, comprising a lower part of the container, which has a cavity which can be filled with the liquid and an accommodating part for the contact lenses, an upper part of the container, which can be closed in sealing manner with the lower part of the container in a closed position, and also has a cavity, and a cover part in the upper part of the container, which cover part interacts with the accommodating part in the lower part of the container when the container is in the closed position, wherein the upper part of the container has a weight which is greater than the weight of the lower part of the container filled with the liquid, the weight of the upper part of the container creating a stable position when the upper part of the container is disposed beneath the lower part of the container, and wherein the container has a stand part, the accommodating part is connected to be detachable with the associated lower part of the container and the accommodating part is supported by the stand part or the stand part can be connected with the accommodating part.

19. A container for the storage of contact lenses, which can be filled with a liquid which wets the contact lenses, comprising a lower part of the container, which has a cavity which can be filled with the liquid and an accommodating part for the contact lenses, the accommodating part having two separately marked and/or separated compartments, an upper part of the container, which can be closed in sealing manner with the lower part of the container in a closed position, and also has a cavity, and a cover part in the upper part of the container, which cover part interacts with the accommodating part in the lower part of the container when the container is in the closed position, wherein the upper part of the container has a weight which is greater than the weight of the lower part of the container filled with the liquid, the weight of the upper part of the container creating a stable position when the upper part of the container is disposed beneath the lower part of the container.

* * * * *